United States Patent [19]

Rohme

[11] 4,070,074

[45] Jan. 24, 1978

[54] TAMPER-PROOF CABINET

[75] Inventor: George Rohme, College Point, N.Y.

[73] Assignee: Superior Steel Door & Trim Co., Inc., College Point, N.Y.

[21] Appl. No.: 790,333

[22] Filed: Apr. 25, 1977

[51] Int. Cl.[2] ..... A47B 81/00; E05D 15/56; E06B 3/50

[52] U.S. Cl. ..... 312/245; 49/257; 109/70; 312/204; 312/209

[58] Field of Search ..... 312/245, 204, 209; 109/69, 70; 49/254, 257; 70/78, 81, 83

[56] References Cited

U.S. PATENT DOCUMENTS

| | | | |
|---|---|---|---|
| 674,490 | 5/1901 | Watkins | 49/257 |
| 3,014,608 | 12/1961 | Aylor | 49/254 |
| 3,270,462 | 9/1966 | Obadal et al. | 49/257 |

*Primary Examiner*—Paul R. Gilliam

*Assistant Examiner*—Alex Grosz

*Attorney, Agent, or Firm*—Bauer, Amer & King

[57] ABSTRACT

A cabinet in which the closure or door thereof is rendered less vulnerable to unauthorized tampering which seeks to bypass the lock thereof as a result of the door being latched behind an edge of the cabinet front opening. Thus, opening of the door contemplates a compound movement, i.e. an initial unlatching sliding movement, and then the usual pivotal traverse from its closed into its open position. As a significant improvement, the construction of the within cabinet effectively masks the presence of the structural features which contribute to the door compound movement, whereas this is not the case with prior art cabinet doors and, as a result, such omission in an obvious way, detracts from the effectiveness of the security intended to be gained by the compound door movement.

5 Claims, 5 Drawing Figures

TAMPER-PROOF CABINET

The present invention relates generally to cabinets, and more particularly to improvements for effectively rendering a cabinet tamper-proof.

As understood, a pivotally mounted closure or cabinet door is considerably more difficult to pry open if the free end thereof, in the closed position of the door, is latched behind an edge bounding the door opening. Such a door is proposed, for example, in prior U.S. Pat. No. 1,923,787. However, while the need to first unlatch and then urge the door through an opening pivotal traverse should immeasurably contribute to the security of the cabinet having such a door, this unfortunately is not the case because invariably the cabinet construction readily exposes the structural features providing this result. To the extent that the foregoing is readily discernible, it alerts unauthorized persons as to what is required to open the cabinet and thus defeats obtaining the results being sought.

Broadly, it is an object of the present invention to provide an improved tamper-proof cabinet overcoming the foregoing and other shortcomings of the prior art. Specifically, it is an object to advantageously utilize the door-latching structural component to also mask, and thus prevent tampering with, the structural features that allow for the unlatching sliding movement in the door, thus providing the within cabinet with the appearance of a conventional cabinet even though, in fact, it requires the special procedures herein noted in order to be opened.

An improved tamper-proof cabinet demonstrating objects and advantages of the present invention includes a cooperating arrangement of upper, lower and opposite side walls bounding a storage compartment for said cabinet having a first rectangular opening thereinto. A frame bounding an inner second rectangular opening of a selected smaller size than said first opening and of a selected external size larger than said cabinet is disposed in surrounding relation about the first opening so that the frame presents a surface extending in overhanging relation on at least one side of the first opening. The cabinet door, having vertically oriented pivot pins extending in opposite directions therefrom, is operatively mounted for pivotal opening and closing movements relative to the second opening and is sized slightly larger in its horizontal dimension than said second opening so that in the door closed position, an edge thereon is in a desirable latched position behind the above noted vertically oriented overhanging surface of the frame. Completing the cabinet construction are springs connected in spanning relation between the cabinet housing walls and the door pivot pins, said springs being in positions masked from view behind cooperating upper and lower horizontally oriented overhanging surfaces of the frame. As a result, door pivotal opening movement is required to be preceded by an unlatching door sliding movement in the plane of the second opening as permitted by the expansion of said spring means, and an observer is not alerted to this requirement.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 2:
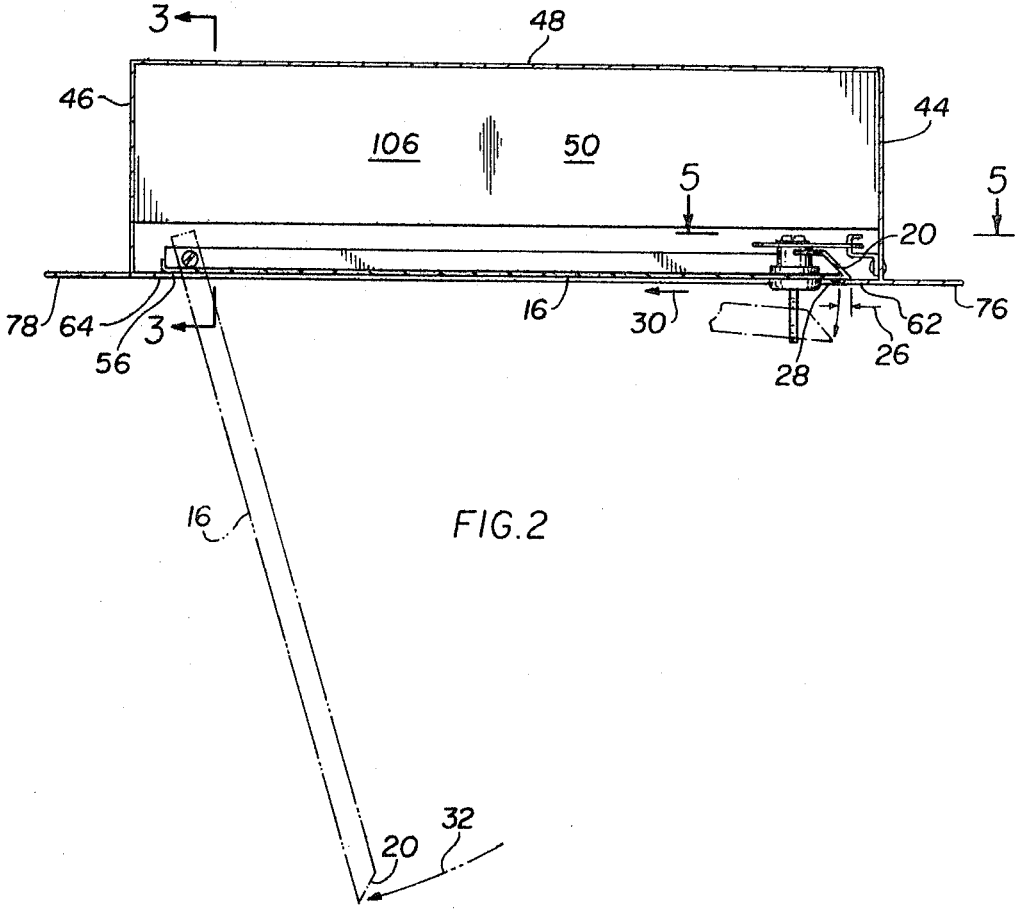
FIG. 2 is a plan view, in section, taken along line 2—2 of FIG. 1, showing further structural details.
Figure 5:
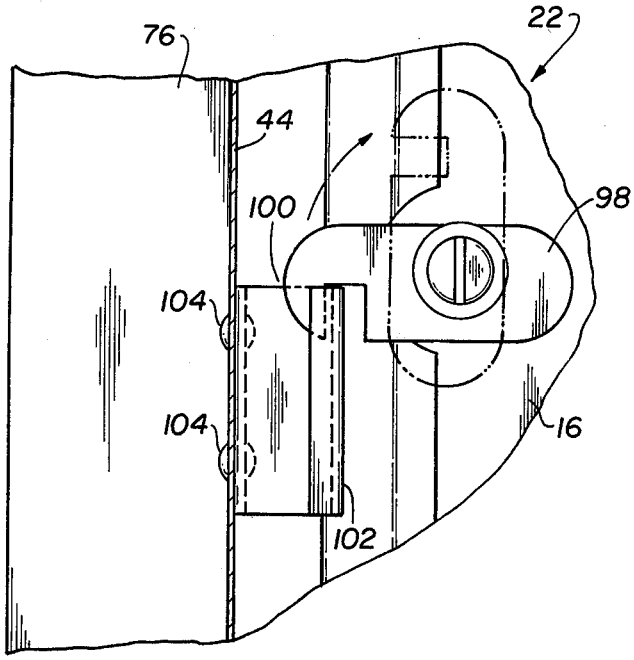
Figure 3:
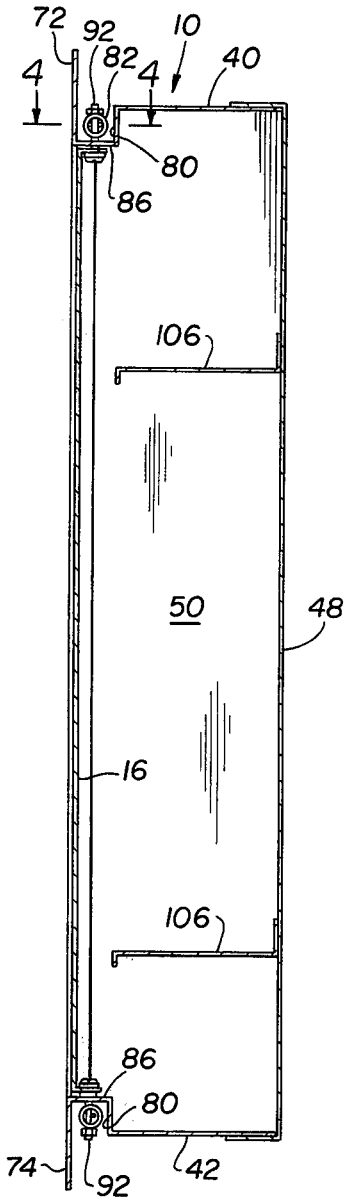
FIG. 3 is an elevational view, in section taken along line 3—3 of FIG. 2, which illustrates details of the pivot axis of the closure or door member.
Figure 4:
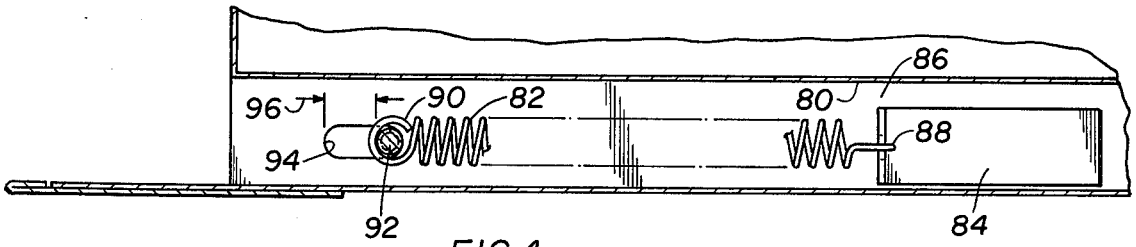

FIG. 4 is a partial plan view, on an enlarged scale, in section taken along line 4—4 of FIG. 3, which illustrates details of the spring operatively associated with the pivot axis for the closure or door member; and FIG. 5 is a partial front elevational view of an acceptable lock for the within cabinet, the same being illustrated as though seen from the rear and thus in the direction of the arrows 5—5 of FIG. 2.

Figure 1:
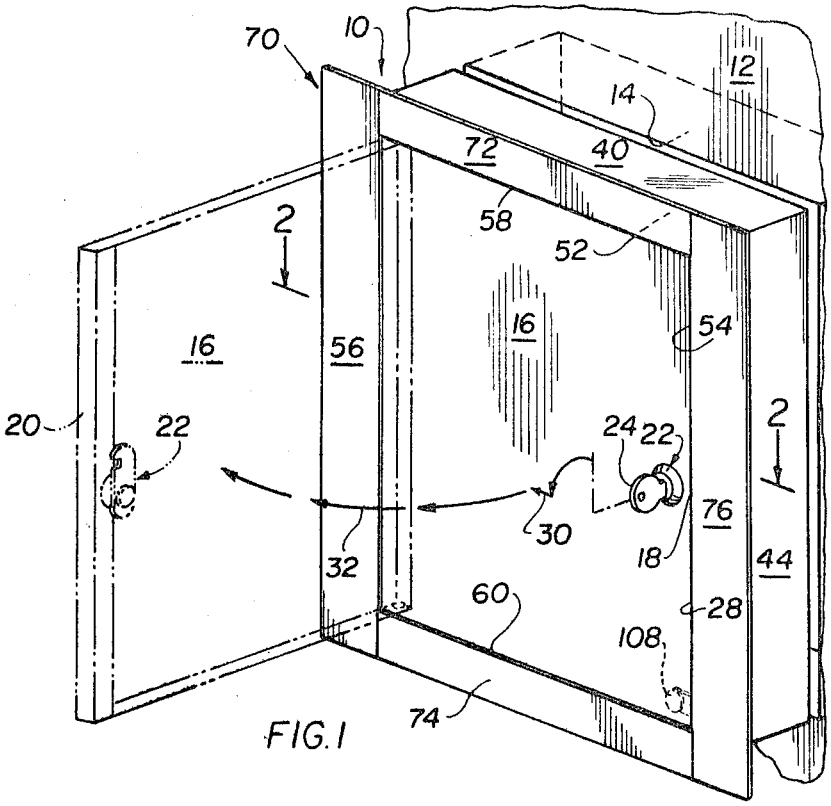
FIG. 1 is a perspective view of an improved tamper-proof cabinet according to the present invention, the closure or door member thereof being respectively shown in its closed and opened positions in full line and phantom line perspective.

Reference is now made to the drawings, and more particularly initially to FIG. 1, wherein there is shown an improved tamper-proof cabinet, generally designated 10, according to the present invention, said cabinet being adapted to be mounted in a support wall 12 and, more particularly, in a rectangular opening 14 therein appropriately sized to receive the cabinet 10. Consistent with the contemplated end use of cabinet 10 for the storage of valuables and the like, it is a major objective of its construction that it be tamper-proof, and by this is meant that its construction presents significant obstacles to any unauthorized persons attempting to force open the closure member or door 16 of the cabinet. In most instances, tampering with the door 16 for the unauthorized purpose just mentioned, involves attempting to insert an object, as at the strategic locations 18, past that portion of the door front edge 20 adjacent the lock 22, all to the end of manipulating lock 22 open without having to use a key 24. To obviate bypassing the lock 22 in the manner just described, the construction of the within cabinet 10, as is perhaps best illustrated in FIG. 2, thus contemplates that in the closed position of the door 16 that the front edge 20 thereof extend a distance 26 laterally beyond and behind the vertical edge 28 which bounds the cabinet front opening, i.e. the opening in which door 16 is mounted for pivotal movement between closed and opened positions, as illustrated in full line and phantom line perspective in both FIGS. 1 and 2. Thus, front edge 20 is latched behind edge 28 and thus must be unlatched by a sliding movement 30 for the previously noted distance 26 before the door 16 can be urged through pivotal movement 32 from its closed into its open position. The manner in which this is achieved, as well as noteworthy structural features of the cabinet 10, will now be explained.

Since cabinet 10 is intended for storage of valuables, although it will of course be understood that it is not limited to this end use, it is preferably comprised of sheet metal or other construction material that cannot be readily burglarized or vandalized. Structure-wise, cabinet 10 includes a cooperating arrangement of an upper wall 40, a lower wall 42 (see FIG. 3), opposite side walls 44 and 46, and a rear wall 48, which walls together bound a rectangular volume 50 which serves as a storage compartment for the cabinet 10. Naturally, the front edges of the walls just referred to, except of course the rear wall 48, bound a first opening, herein designated 52, which provides access to the compartment 50. As will be explained, however, the full dimension or size of opening 52 is not the actual opening in which door 16 is pivotally mounted, but rather that opening, of which previously referred to edge 28 is one of the edges bounding the same, is of a selected smaller size than opening 52. More particularly, the smaller-sized opening, herein designated 54, in which door 16 is pivotally mounted, is that which is bounded by the already referred to edge 28 and also by an opposing or opposite vertically oriented edge 56, and by two upper and lower horizontally oriented edges 58 and 60, respectively. At this location in the description noting that opening 54 is of a selected smaller size than opening 52, it is perhaps convenient also to note that the smaller size in said opening 54 is due to the fact that a frame, soon to be described, is attached about opening 52 and, as already noted, thus presents the latching surface, as measured by distance 26 as an overhang 62 along the edge 28 into said opening 52. In similar fashion, an overhang 64 is also provided along the other vertically oriented edge 56. Thus, said second opening 54 is smaller than said first opening 52 to the extent of the surfaces 62 and 64 which extend in overhanging relation along the vertically oriented edges 28 and 56.

Said smaller-sized opening 54 which actually functions as the front opening of the cabinet 10 is an opening bounded by a construction, generally designated 70, which frames the front of the cabinet 10. In a preferred construction as illustrated herein, frame 70 includes upper and lower panels 72 and 74, respectively, which are extensions of the upper and lower walls of the cabinet, said extensions being bent perpendicularly of said walls. Thus, in a manner which will be subsequently described in detail, panels 72 and 74 effectively function as tamper-preventing surfaces for the cabinet 10. Completing frame 70 are vertically oriented members 76 and 78 which are each mounted in the vertical orientation illustrated and are each appropriately connected, as by being welded, to the front edges of the walls 44 and 46 as well as to the horizontally oriented previously referred to panels 72 and 74. As already noted, members 76 and 78 are located relative to the larger opening 52 so as to provide the previously referred to overhangs 62 and 64, and thus the smaller-sized front opening 54. Specifically, member 76 provides the previously referred to latching surface 26 for the door front edge 20, while member 78, by virtue of its overhang 64, provides a tamper-preventing surface in protecting relation to the vertical axis for the door 16, all as will become more apparent as the description proceeds.

As already noted, members or surfaces 72 and 74 of the frame 70 provide a tamper-preventing function for the cabinet 10. This function, more particularly, is to serve as an obstruction and surface masking the presence of the structural features, now to be described, which allow for the unlatching sliding movement 30 in the door 16 which frees the door end 20 from its position behind front edge 28. This sliding movement 30, it will be recalled, is what is necessary in order to unlatch the door 16 from its closed position preparatory to the door being able to be urged through a pivotal traverse 32 into its open position. The structural features in the door 16 related to said sliding movement 30 are perhaps best illustrated in FIGS. 3 and 4, to which reference should now be made. Specifically, each of the upper and lower walls 40 and 42, respectively, is formed with a recess 80 which, in cross-section, is generally rectangular. Horizontally disposed in each recess 80 is a helical spring 82, as best shown in FIG. 4. A bracket 84 is welded or otherwise fixedly connected to the bottom wall 86 of each recess 80, and one end of spring 82 is connected thereto, as at 88. The other end 90 of spring 82 is attached to a cooperating one of a pair of pivot pins 92 which extend in opposite directions from door 16 adjacent its end remote from the front edge 20. More particularly, and as is perhaps best illustrated in FIG. 4, the recessed bottom wall 86 is provided with an elongated slot through which is projected a cooperating pivot pin 92 that is engaged, as at 92, by the spring 82. Thus, to the extent of the clearance 96 of the slot 94, it is possible to urge the door 16 through unlatching sliding movement 30, such movement being allowed by expansion of the spring 82. Once the door front edge 20 slides in the direction 30 sufficient to clear the vertical edge 28, it is of course then possible to move the door 16 through an opening pivotal traverse 32.

The closing of the door 16 of course merely contemplates moving the same from its open position as illustrated in phantom perspective in FIG. 1 through a reverse direction pivotal traverse in which the door again functions as a closure for the cabinet 10. During this closing movement, the latching of the door front edge 20 behind the edge 28 is facilitated by the fact the edge 20 is angled as illustrated which in effect cams door 16 slightly in the direction 30 so that the point of the edge 20 can clear edge 28. Of course once edge 28 is cleared, spring 82 is effective in moving the door 16 from left to right and thus projecting edge 20 into its latched position behind frame member 76.

For completeness sake, there has been illustrated in FIG. 5 structural details of the lock 22. As illustrated, this lock includes a rotatably mounted hook member 98 on the door 16 which can be rotated into a closed position in which it engages, as at 100, a cooperating holding bracket 102 which is attached, as by rivets 104, to the interior of the cabinet wall 44. The procedure for authorized opening of the door 16 contemplates insertion of the key 24 within the lock 22, rotation of the lock into its open position, and then using the key 24 as a convenient grip on the door 16 for urging it through unlatching sliding movement 30 past the edge 28, and afterwards through the pivotal traverse 32.

By way of completing the description of the cabinet 10, it will be noted, as for example in FIG. 3, that the storage compartment 50 may be appropriately subdivided by shelves 106. Also, as illustrated in FIG. 1, a bumper stop 108 is advantageously provided in the path of closing movement of the door 16 to appropriately limit this movement, so that the door is properly located in the cabinet front opening 54 in its closed position.

From the foregoing, it should be readily appreciated that the compound sliding and pivotal movements for opening the door 16 adds to the effectiveness of the cabinet 10 as a storage device for valuables, as well as for material that might be dangerous if accessible to children in a conventional way. Moreover, and most significant, bypassing the compound movement of the door 16 is obviated by the frame 70, and more particularly by the tamper-preventing surfaces 72 and 74 thereof which mask from view the presence of the springs 82 and other associated structural features which, if known, would indicate the requirement of compound movements during the opening of the door 16.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. An improved tamper-proof cabinet comprising a cooperating arrangement of upper, lower and opposite side walls bounding a storage compartment for said cabinet having a first rectangular opening thereinto, a frame bounding an inner second rectangular opening of a selected smaller size than said first opening and of a selected external size larger than said cabinet disposed in surroundng relation about said first opening so that said frame presents a surface extending in overhanging relation along at least one vertically oriented side of said first opening, a cabinet door member having vertically oriented pivot pins extending in opposite directions therefrom operatively mounted for pivotal opening and closing movements relative to said second opening and sized slightly larger in its horizontal dimension than said second opening so that in said closed position thereof an edge thereon is in latched relation behind said vertically oriented overhanging surface of said frame, and spring means connected in spanning relation between said cabinet housing walls and said pivot pins in positions masked from view behind cooperating upper and lower horizontally oriented overhanging surfaces of said frame, whereby said door pivotal opening movement is required to be preceded by an unlatching door sliding movement in the plane of said second opening as permitted by the expansion of said spring means wherein each said upper and lower cabinet wall is recessed to accommodate a cooperating one of said spring means and thereby present a rectangular shaped profile, whereby said cabinet is adapted to be mounted in an opening of a support wall having a corresponding rectangular shape.

2. An improved tamper-proof cabinet as claimed in claim 1 wherein each said upper and said lower cabinet housing wall includes an elongated slot through which is projected a cooperating one of said door pivot pins, whereby each said slot both allows said sliding movement and effectively guides the same.

3. An improved tamper-proof cabinet as claimed in claim 2 wherein said frame has as its said upper and lower horizontally oriented surfaces extensions of said respective upper and lower cabinet housing walls which are bent in perpendicular relation to said walls, and said remaining vertically oriented surfaces thereof are separate rectangular shaped members appropriately operatively arranged to cooperate with said bent extensions to provide said surfaces framing said cabinet first opening.

4. An improved tamper-proof cabinet comprising housing walls cooperating to define a storage compartment and having edges thereon bounding a front access opening into said compartment, a pair of tamper-preventing surfaces extending from said front opening upper and lower horizontally oriented edges respectively bent substantially perpendicularly of said front opening, a pair of framing members connected along the remaining spaced apart vertical edges of said front opening to as to respectively present an additional tamper-preventing surface in overhanging relation to one said edge and a latching surface similarly in overhanging relation to said other edge, a cabinet door member having vertically oriented pivot pins extending in opposite directions therefrom operatively mounted for pivotal opening and closing movements relative to said front opening along a vertical axis located behind said additional tamper-preventing surface and sized so that in said closed position thereof an edge thereon is in latched relation behind said latching surface, and spring means connected in spanning relation between said housing walls and said pivot pins behind said upper and lower tamper-preventing surfaces, whereby said door pivotal opening movement is required to be preceded by an unlatching door sliding movement in the plane of said front opening as permitted by the expansion of said spring means wherein those of said housing walls defining the upper and lower portions of said storage compartment are each recessed to accommodate a cooperating one of said spring means and thereby present a rectangular shaped profile, whereby said cabinet is adapted to be mounted in an opening of a support wall having a corresponding rectangular shape.

5. An improved tamper-proof cabinet as claimed in claim 4 wherein each said upper and lower cabinet housing wall includes an elongated slot through which is projected a cooperating one of said door pivot pins, whereby each said slot both allows said sliding movement and effectively guides the same.

* * * * *